United States Patent [19]

Cha

[11] 4,192,381

[45] Mar. 11, 1980

[54] IN SITU RETORTING WITH HIGH TEMPERATURE OXYGEN SUPPLYING GAS

[75] Inventor: Chang Y. Cha, Bakersfield, Calif.

[73] Assignee: Occidental Oil Shale, Inc., Grand Junction, Colo.

[21] Appl. No.: 964,146

[22] Filed: Nov. 28, 1978

Related U.S. Application Data

[63] Continuation of Ser. No. 815,255, Jul. 13, 1977, abandoned, which is a continuation-in-part of Ser. No. 796,696, May 13, 1977, Pat. No. 4,089,375, which is a continuation-in-part of Ser. No. 615,558, Sep. 22, 1975, Pat. No. 4,036,299, which is a continuation-in-part of Ser. No. 492,289, Jul. 26, 1974, abandoned.

[51] Int. Cl.[2] ..... E21B 43/24

[52] U.S. Cl. ..... 166/261; 166/259; 299/2

[58] Field of Search ..... 166/261, 256, 259, 247, 166/260, 272; 299/2–4

[56] References Cited

U.S. PATENT DOCUMENTS

| | | | |
|---|---|---|---|
| 2,917,296 | 12/1959 | Prentiss | 166/259 X |
| 3,284,281 | 11/1966 | Thomas | 166/259 |
| 3,318,798 | 5/1967 | Kondis et al. | 208/11 |
| 3,454,958 | 7/1969 | Parker | 166/256 |
| 3,521,709 | 7/1970 | Needham | 166/259 X |
| 3,577,338 | 5/1971 | Gifford | 208/11 |
| 3,605,890 | 9/1971 | Holm | 166/261 |
| 3,661,423 | 5/1972 | Garrett | 299/2 |
| 3,700,035 | 10/1972 | Lange | 166/261 |
| 4,018,280 | 4/1977 | Daviduk et al. | 299/2 X |
| 4,059,152 | 11/1977 | Allen et al. | 166/261 |

FOREIGN PATENT DOCUMENTS

| | | |
|---|---|---|
| 17.162 | 7/1976 | Morocco . |
| 17.239 | 10/1976 | Morocco . |

*Primary Examiner*—Stephen J. Novosad
*Attorney, Agent, or Firm*—Christie, Parker & Hale

[57] ABSTRACT

Liquid and gaseous products are recovered from an in situ oil shale retort containing a fragmented permeable mass of formation particles by establishing a combustion zone in the fragmented permeable mass of particles. The combustion zone is advanced through the fragmented mass of particles by introducing a retort inlet mixture comprising oxygen into the retort on the trailing side of the combustion zone. The retort inlet mixture is maintained at a sufficiently high temperature of at least 1150° F. so that the temperature of at least a portion of the fragmented mass on the trailing side of the combustion zone is maintained at a temperature of at least 1150° F. for increasing the yield of hydrocarbon products obtained from the retort.

29 Claims, 1 Drawing Figure

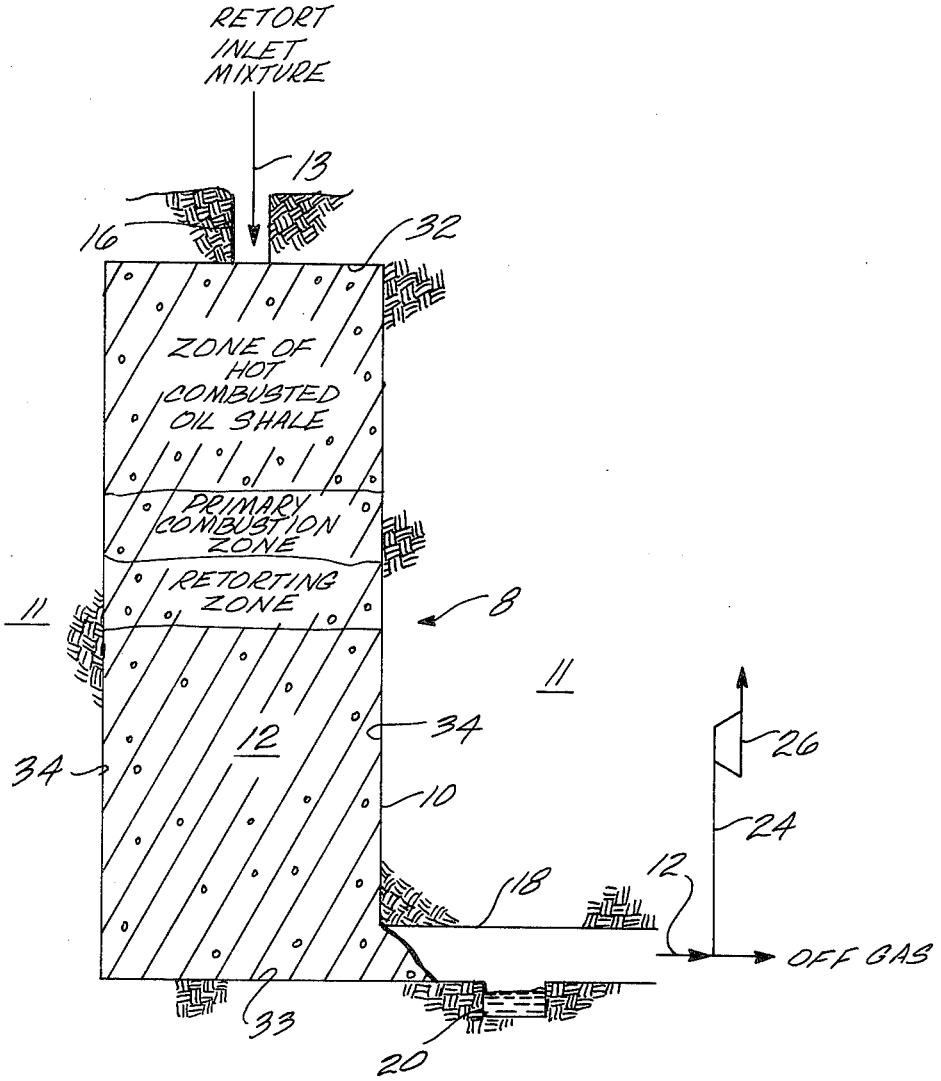
RETORT
INLET
MIXTURE
13
16
32
ZONE OF
HOT
COMBUSTED
OIL SHALE
PRIMARY
COMBUSTION
ZONE
RETORTING
ZONE
11
8
11
12
34
34
10
26
24
12
18
OFF GAS
33
20

IN SITU RETORTING WITH HIGH TEMPERATURE OXYGEN SUPPLYING GAS

CROSS-REFERENCES

This application is a continuation of application Ser. No. 815,255, filed July 13, 1977, now abandoned, which is a continuation-in-part of U.S. patent application Ser. No. 796,696 filed on May 13, 1977, now U.S. Pat. No. 4,089,375 which is a continuation-in-part of application Ser. No. 615,558, filed Sept. 22, 1975, and now U.S. Pat. No. 4,036,299, which is a continuation-in-part of application Ser. No. 492,289, filed July 26, 1974, and now abandoned. All three of these applications are incorporated herein by this reference.

This application is also related to my prior applications Ser. No. 465,097, filed Apr. 29, 1974, now abandoned; Ser. No. 648,358, filed Jan. 12, 1976, now abandoned; and Ser. No. 728,911, filed Oct. 4, 1976, now abandoned.

BACKGROUND OF THE INVENTION

The presence of large deposits of oil shale in the Rocky Mountain region of the United States has given rise to extensive efforts to develop methods of recovering shale oil from kerogen in the oil shale deposits. It should be noted that the term "oil shale" as used in the industry is in fact a misnomer; it is neither shale nor does it contain oil. It is a sedimentary formation comprising marlstone deposit with layers containing an organic polymer called "kerogen", which upon heating decomposes to produce liquid and gaseous products. It is the formation containing kerogen that is called "oil shale" herein, and the liquid hydrocarbon product is called "shale oil".

A number of methods have been proposed for processing the oil shale which involve either first mining the kerogen bearing shale and processing the shale on the surface, or processing the shale in situ. The latter approach is preferable from the standpoint of environmental impact since the spent shale remains in place, reducing the chance of surface contamination and the requirement for disposal of solid wastes.

The recovery of liquid and gaseous products from oil shale deposits has been described in several patents, one of which is U.S. Pat. No. 3,661,423, issued May 9, 1972, to Donald E. Garrett, assigned to the assignee of this application and incorporated herein by reference. This patent describes in situ recovery of liquid and gaseous hydrocarbon materials from a subterranean formation containing oil shale by fragmenting such formation to form a stationary, fragmented permeable body or mass of formation particles containing oil shale within the formation, referred to herein as an in situ oil shale retort. Hot retorting gases are passed through the in situ oil shale retort to convert kerogen contained in the oil shale in liquid and gaseous products, thereby producing "retorted oil shale".

One method of supplying hot retorting gases used for converting kerogen contained in the oil shale, as described in U.S. Pat. No. 3,661,423, includes establishment of a combustion zone in the retort and introduction of an oxygen containing retort inlet mixture downwardly into the retort as an oxygen supplying gaseous combustion zone feed to advance the combustion zone downwardly through the retort. In the combustion zone oxygen in the combustion zone feed is depleted by reaction with hot carbonaceous materials to produce heat and combustion gas. By the continued introduction of the retort inlet mixture downwardly into the retort, the combustion zone is advanced downwardly through the retort.

The combustion gas and the portion of the combustion zone feed that does not take part in the combustion process pass through the fragmented mass in the retort on the advancing side of the combustion zone to heat the oil shale in a retorting zone to a temperature sufficient to produce kerogen decomposition, called retorting, in the oil shale to gaseous and liquid products including gaseous and liquid hydrocarbon products and to a residual soild carbonaceous material.

The liquid products and gaseous products are cooled by the cooler oil shale fragments in the retort on the advancing side of the retorting zone. The liquid hydrocarbon products, together with water produced in or added to the retort, are collected at the bottom of the retort. An off gas containing combustion gas generated in the combustion zone, gaseous products produced in the retorting zone, gas from carbonate decomposition, and any gaseous retort inlet mixture that does not take part in the combustion process is also withdrawn from the bottom of the retort. The products of retorting are referred to herein as liquid and gaseous products.

The residual carbonaceous material in the retorted oil shale can be used as fuel for advancing the combustion zone through the retorted oil shale. When the residual carbonaceous material is heated to its spontaneous ignition temperature it reacts with oxygen. The portion of the retort where the greater part of the oxygen in the retort inlet mixture that reacts with residual carbonaceous material in retorted oil shale is consumed is called the primary combustion zone. It is characterized by a temperature which is higher than in other parts of the retort. As the residual carbonaceous material becomes depleted in the combustion process, the oxygen penetrates farther into the oil shale retort where it combines with remaining unoxidized residual carbonaceous material, thereby causing the combustion zone to advance through the fragmented oil shale.

The rate of retorting of the oil shale to liquid and gaseous products is temperature dependent, with relatively slow retorting occurring at 600° F., and relatively rapid retorting of the kerogen in oil shale occurring at 950° F. and higher temperatures. As the retorting of a segment of the fragmented oil shale in the retorting zone progresses and less heat is extracted from the gases passing through the segment, the combustion gas heats the oil shale farther on the advancing side of the combustion zone to retorting temperatures, thus advancing the retorting zone on the advancing side of the combustion zone.

It can be desirable to limit the oxygen content of the combustion zone feed to about 15%. At oxygen concentrations higher than about 15%, high primary combustion zone temperatures resulting in fusion of the oil shale can occur if a high volumetric flow rate of combustion zone feed is provided. Thus to reduce the oxygen content of air, which is presently the most economical source of oxygen, the air can be diluted with a portion of off gas generated by retorting of oil shale. However, it has been found that when recycled off gas is used to dilute the air, the off gas from the retort can have a fuel value of only about 45 BTU/SCF (British thermal units per standard cubic foot), which can be insufficient to power a work engine.

It is desirable to provide a method for retorting an in situ oil shale retort such that the retort off gas generated during retorting has sufficient fuel value for combustion in a stack or for use in power generation in a work engine.

When off gas recycling is used to dilute air, a narrow combustion zone is generated. With off gas recycling, it is calculated that for a combustion zone having a maximum temperature of 1400° F., the thickness of a primary combustion zone having a temperature of 1300° F. on its leading edge and a temperature of 900° F. on its trailing edge can be about 0.8 foot. With such a narrow primary combustion zone, oxygen from the primary combustion zone can oxidize hydrocarbon products produced in the retorting zone, thereby lowering the hydrocarbon yield from the retort.

The introduction of a gaseous retort inlet mixture into the retort on the trailing side of the combustion zone and the flowing of such gas therethrough generally reduces the temperature of the fragmented permeable mass of particles on the trailing side of the combustion zone. When the retort inlet mixture feed is introduced into the retort at atmospheric temperature, the fragmented permeable mass on the trailing side of the combustion zone can have its temperature reduced to a temperature below the retorting temperature of oil shale. This reduction in temperature terminates the retorting of oil shale in unfragmented formation adjacent to such fragmented permeable mass of particles, thereby reducing the recovery from the retort.

This can also reduce the temperature of residual carbonaceous material in oil shale on the trailing side of the primary combustion zone to a temperature below the spontaneous ignition temperature of such materials. The residual carbonaceous material cannot be oxidized to provide the energy required for the endothermic retorting of oil shale, thereby requiring oxidation of kerogen which otherwise could be retorted to yield hydrocarbon products.

Thus, it is desirable to provide a method for recovering liquid and gaseous products from an in situ oil shale retort which yields off gas of sufficient fuel value to operate a work engine and which gives high recovery of product.

SUMMARY OF THE INVENTION

In a method of this invention a combustion zone is advanced through an in situ oil shale retort in a subterranean formation containing oil shale. The retort contains a fragmented permeable mass of formation particles containing oil shale. The combustion zone is advanced through the retort by introducing into the retort on the trailing side of the combustion zone a retort inlet mixture comprising oxygen.

The retort inlet mixture is maintained at a sufficiently high temperature of at least about 1150° F. so that the temperature of at least a portion of the fragmented mass on the trailing side of the combustion zone is maintained at a temperature of at least 1150° F. Thus there is a zone of hot combusted oil shale on the trailing side of the combustion zone.

Heat from the zone of hot combusted oil shale retorts unfragmented formation adjacent the zone of hot combusted oil shale resulting in production of hydrocarbon products. In addition, oxygen in the retort inlet mixture can react with residual carbonaceous material in combusted oil shale on the trailing side of the combustion zone, thereby producing heat required for retorting oil shale in the retorting zone.

Preferably the retort inlet mixture contains from about 10 to about 50% water vapor by volume. Such water vapor can react with residual carbonaceous material in combusted oil shale on the trailing side of the combustion zone to produce hydrogen and carbon monoxide.

DRAWING

These and other features, aspects and advantages of the present invention will become more apparent when considered with respect to the following description, appended claims, and accompanying drawing which illustrates semi-schematically an in situ oil shale retort useful in the practice of this invention.

DESCRIPTION

An aspect of this invention concerns an improved method for recovering liquid and gaseous products from an in situ oil shale retort. Referring to the drawing, as in situ oil shale retort 8 is in the form of a cavity 10 in a subterranean formation 11 containing oil shale. The in situ retort contains a fragmented permeable mass 12 of formation particles containing oil shale. The fragmented mass can have a wide distribution of particle sizes. For example, an in situ oil shale retort in the Piceance Creek basin of Colorado prepared by explosive expansion of formation towards a void contained a fragmented permeable mass consisting of about 58% by weight particles having a weight average diameter of 2 inches, about 23% by weight particles having a weight average diameter of 8 inches, and about 19% by weight particles having a weight average diameter of 30 inches. The retort has top 32, bottom 33, and side 34 boundaries of unfragmented formation serving as gas barriers. In a subterranean formation containing a plurality of retorts, as much as from 20% to 40% of the formation can remain unfragmented. The cavity and fragmented mass of oil shale particles can be created simultaneously by blasting by any of a variety of techniques. A method of forming an in situ oil shale retort is described in the aforementioned U.S. Pat. No. 3,661,423.

In a presently preferred embodiment of a process practiced according to principles of this invention, a retort inlet mixture 13 containing a source of oxygen such as air is introduced downwardly through a conduit 16 as a combustion zone feed into the retort on the trailing side 15 of a primary combustion zone advancing through the fragmented mass in the retort. As described in greater detail hereinafter, the retort inlet mixture is maintained at an elevated temperature of at least about 1150° F. The gaseous combustion zone feed passes downwardly into the primary combustion zone where hot combustion gas is produced. The combustion gas and any unreacted portion of the retort inlet mixture pass from the advancing side of the combustion zone downwardly through a retorting zone in which gaseous and liquid products are produced by retorting oil shale.

The liquid and gaseous products flow downwardly through the mass 12 of formation particles on the advancing side of the retorting zone into a drift, adit, tunnel 18, or the like, in communication with the bottom of the retort. The drift contains a sump 20 in which liquid products including shale oil and water are collected and from which liquid products are withdrawn through conduit means, not shown. A retort off gas 22 containing gaseous products, combustion gas, carbon dioxide from carbonate decomposition, and any gaseous unreacted portion of the retort inlet mixture is also withdrawn by way of the drift. A portion of the retort off gas can be conveyed by line 24 for combustion in a work engine such as a gas turbine 26.

Above the primary combustion zone, there is a zone of hot combusted oil shale at elevated temperature due to the passage of the retort inlet mixture therethrough. As used herein, the term "combusted oil shale" refers to oil shale through which a primary combustion zone has passed, the combusted oil shale having reduced carbon content due to oxidation. As used herein, the term "retorted oil shale" refers to oil shale heated to a sufficient temperature to decompose kerogen in an environment substantially free of free oxygen so as to produce liquid and gaseous products and leave a solid carbonaceous residue. An individual particle containing oil shale can have a core of retorted oil shale and an outer "shell" of combusted oil shale. Such can occur when oxygen has diffused only part way through the particle during the time it is at an elevated temperature and in contact with an oxygen supplying gas. As used herein, the term "raw oil shale" refers to oil shale which has not been subjected to processing for decomposing kerogen in the oil shale.

To initiate retorting, carbonaceous material in the oil shale is ignited by any known method as, for example, the method described in U.S. Pat. No. 3,661,423, incorporated herein by this reference or U.S. Pat. application Ser. No. 772,760, filed Feb. 28, 1977 by me, now abandoned and assigned to the assignee of this invention, and incorporated herein by this reference. In establishing a primary combustion zone by the method described in the aforementioned application, a combustible gaseous mixture is introduced into the retort through the conduit 16 and ignited. Retort off gas is withdrawn through the drift 18, thereby bringing about a movement of gas from top to bottom of the retort through the fragmented permeable mass of particles containing oil shale. The combustible gaseous mixture contains an oxygen supplying gas such as air and a fuel such as propane, butane, shale oil, natural gas, or the like. The supply of the combustible gaseous mixture to the primary combustion zone is maintained for a period sufficient for oil shale in the fragmented mass near the upper boundary of the retort to become heated to a temperature higher than the spontaneous ignition temperature of carbonaceous material in the shale, and generally higher than about 900° F., so that the combustion zone can be sustained by the introduction of oxygen supplying gas without fuel. At a temperature higher than about 900° F., gases passing through the primary combustion zone and the combustion gas are at a sufficiently high temperature to rapidly retort oil shale on the advancing side of the combustion zone. The period of establishing a self-sustaining primary combustion zone can be from about one day to about a week in duration. When a self-sustaining primary combustion zone has been formed, the retort off gas has little or no oxygen content because oxygen in the combustible gaseous mixture is depleted as the combustible gaseous mixture passes through the primary combustion zone.

After a self-sustaining primary combustion zone is formed, the retort inlet mixture 13 is introduced into the retort on the trailing side of the primary combustion zone. The retort inlet mixture has a sufficiently high temperature of at least about 1150° F. for maintaining the temperature of at least a portion of the fragmented mass on the trailing side of the combustion zone at a temperature of about 1150° F. The portion of the fragmented permeable mass on the trailing side of the primary combustion zone which has a temperature of at least 1150° F. is referred to herein as a zone of hot combusted oil shale.

The temperature of the retort inlet mixture is controlled to maintain a desired temperature in the zone of hot combusted oil shale. By maintaining a zone of hot combusted oil shale on the trailing side of the combustion zone, the zone having a temperature of at least about 1150° F., several desirable phenomena can occur. For example, kerogen in unfragmented formation adjacent the zone of hot combusted oil shale and kerogen present in any oil shale in the fragmented mass bypassed by the primary combustion zone, such as oil shale in the upper corners of the retort, can be retorted. This can result in increased yield of hydrocarbons from the retort.

Preferably the zone of hot combusted oil shale is maintained at a temperature of at least about 1150° F. to maintain the temperature of unfragmented formation adjacent the secondary combustion zone at a temperature greater than the retorting temperature of oil shale. By maintaining the retort walls adjacent the zone of hot combusted oil shale at elevated temperatures, heat is transferred by conduction into the unfragmented formation for recovery of hydrocarbon values from kerogen in the unfragmented formation which otherwise might not be recovered. Preferably, the unfragmented formation adjacent the zone of hot combustion oil shale is maintained at a temperature greater than about 900° F. to obtain recovery of hydrocarbon values from kerogen in the unfragmented formation, more preferably greater than about 1000° F. for a high rate of conduction of heat into the unfragmented formation walls, and it is particularly preferred to maintain the unfragmented formation adjacent the combustion zone of hot combusted oil shale at a temperature higher than about 1200° F. for maximum recovery of hydrocarbon products from oil shale in such unfragmented formation 34.

Preferably the zone of hot combusted oil shale is maintained at a temperature of at least about 1150° F. for thermal decomposition at an appreciable rate of alkaline earth metal carbonates present in oil shale. Such thermal decomposition results in release of carbon dioxide and formation of the corresponding alkaline earth metal oxide. Oil shale contains appreciable amounts of alkaline earth metal carbonates such as magnesium carbonate and calcium carbonate. Complete decomposition of calcium carbonate to carbon dioxide and calcium oxide occurs at a temperature of about 1517° F. (825° C.).

It is believed that carbon dioxide released by decomposition of alkaline earth metal carbonates can react with residual carbonaceous material within a formation particle according to the reaction:

$$C + CO_2 \rightarrow 2CO \quad (1)$$

The carbon monoxide therein formed can react with oxygen in the retort inlet mixture according to the following reaction:

$$2CO + O_2 \rightarrow 2CO_2 \quad (2)$$

By these reactions, residual carbonaceous material in combusted oil shale which might be left unrecovered can be oxidized with liberation of heat which can be used for retorting oil shale in a retorting zone on the advancing side of the primary combustion zone.

The upper limit on the temperature of the zone of hot combusted oil shale, and thus the upper limit on the temperature of the retort inlet mixture, is determined by the fusion temperature of oil shale, which is about 2100° F. The temperature in the zone of hot combusted oil shale preferably is maintained below about 1800° F. to provide a margin of safety between the temperature in the zone of hot combusted oil shale and the fusion temperature of the oil shale. In this specification, when the temperature of the primary combustion zone or the zone of hot combusted oil shale is mentioned, reference is being made to the maximum temperature in that zone.

As shown in the Drawing, preferably the zone of hot combusted oil shale is established and maintained in a top portion or region of the fragmented permeable mass in the retort near the inlet to the fragmented mass. This is because oil shale on the trailing side of the primary combustion zone and oil shale in unfragmented formation adjacent the fragmented mass on the trailing side of the primary combustion zone are maintained at an elevated temperature due to flowing gasses passing from the zone of hot combusted oil shale to the primary combustion zone. The closer the zone of hot combusted oil shale is to the top of the fragmented mass, the greater is the amount of oil shale in the fragmented mass and oil shale in unfragmented formation maintained at an elevated temperature, and therefore the greater is the amount of kerogen available for retorting and the greater the amount of residual carbonaceous material available for oxidation.

The retort inlet mixture can be generated by directly or by indirectly heating an oxygen containing gas such as air. For example, a solid, liquid, or gaseous fuel can be burned in the presence of excess air to generate a hot fuel gas containing oxygen which can be used as a retort inlet mixture. Suitable gaseous fuels include liquified petroleum gas, natural gas, and retort off gas. Suitable liquid fuels include shale oil, petroleum oil, and refined products thereof. Suitable solid fuels include high grade oil shale, coal, peat, and the like.

The hot retort inlet mixture can also be generated by combining an oxygen containing gas such as air with a hot diluent such as superheated steam produced in a steam plant.

To cause the primary combustion zone to advance through the retort, the rate of introduction of the retort inlet mixture into the retort is at least sufficient to generate combustion zone feed at a superficial volumetric rate of 0.1 SCFM per square foot of cross-sectional area of the fragmented permeable mass being retorted. Preferably the primary combustion zone advances through the fragmented mass at a rate of at least about 0.5 feet per day to produce hydrocarbon products at a sufficiently fast rate to justify the capital investment required for retorting oil shale. At higher rates of advancement of the primary combustion zone, hydrocarbon yield per ton of oil shale being retorted can be adversely affected due to oxidation of hydrocarbon products. Therefore, preferably the primary combustion zone is advanced through the fragmented mass at a rate up to about 2 feet per day to avoid significant yield losses. To cause the primary combustion zone to advance through the retort at an economical rate of about 0.5 to 2 feet per day, depending on the kerogen content of the oil shale through which the primary combustion zone is advancing, the retort inlet mixture is introduced into the retort in the zone of hot combusted oil shale at a rate of from about 0.5 to about 1 SCFM per square foot of cross-sectional area of the fragmented permeable mass being retorted. Introduction of retort inlet mixture into the retort at a rate of more than about 2 SCFM per square foot of cross-sectional area may result in a portion of the oxygen in the retort inlet mixture being carried through an established or desired primary combustion zone location and into the retorting zone. In the retorting zone, such oxygen can burn hydrocarbon products and unretorted carbonaceous material in the oil shale, thereby decreasing shale oil yield. Therefore, it is preferred to introduce the retort inlet mixture into the retort at a rate less than about 2 SCFM per square foot of cross-sectional area of the fragmented permeable mass being retorted.

Suitable oxygen supplying gases are oxygen, air, air enriched with oxygen, and air mixed with a diluent such as nitrogen, off gas from an in situ oil shale retort, steam, and mixtures thereof. For the purposes of this application, water is not considered to be a source of oxygen.

The concentration of oxygen in the retort inlet mixture depends upon such factors as the volumetric flow rate of the retort inlet mixture per square foot of cross-sectional area of the fragmented permeable mass being retorted, desired temperature in the primary combustion zone, and the amount of residual carbonaceous material left in the shale after retorting. A lower concentration of oxygen is needed in the retort inlet mixture as the volumetric flow rate of the retort inlet mixture increases, as the desired temperature in the primary combustion zone decreases, and/or as the concentration of residual carbonaceous material in the retorted oil shale increases. Conversely, a higher concentration of oxygen is required in the retort inlet mixture at lower volumetric rates of the retort inlet mixture, higher desired primary combustion zone temperatures, and/or lower concentrations of residual carbonaceous material.

As a higher concentration of oxygen is introduced into the combustion zone, more heat is generated and the retorting zone advances through the retort faster. The oxygen concentration of the retort inlet mixture zone feed is greater than about 1% by volume to maintain a commercially acceptable advancement rate of the retorting zone. At an oxygen concentration greater than about 20% by volume of the retort inlet mixture, contact of the retort inlet mixture with regions of high concentration of carbonaceous materials in the retort can cause some localized fusion of the fragmented mass of oil shale particles. Fusion of the fragmented mass can restrict the movement of gases through the retort. Therefore, it is preferred to use a retort inlet mixture having from about 1 to about 20% oxygen by volume.

Maintenance of the oxygen concentration at less than about 15% by volume of the retort inlet mixture provides a margin of safety to prevent fusion of the mass of oil shale particles. At an oxygen concentration of at least about 10% by volume of the retort inlet mixture, the maximum temperature in the primary combustion zone can readily be maintained at a desired temperature above the retorting temperature of the oil shale. Therefore, the use of a retort inlet mixture containing from about 10 to about 15% oxygen by volume constitutes a particularly preferred version of this invention.

Beneficial effects, as described below, are obtained from the presence of water vapor in the retort inlet mixture, Therefore, preferably the retort inlet mixture contains water vapor as superheated steam. To obtain significant beneficial effects of the presence of water vapor in the retort mixture, preferably the retort inlet mixture contains at least about 10% by volume of water vapor. In forming the retort inlet mixture, allowance should be made for water resulting from oxidation of any hydrogen containing compounds present in the retort inlet mixture and leakage of water into the retort from underground aquifiers.

The higher the water vapor concentration of the retort inlet mixture, the greater the benefits obtained from the presence of the water vapor. However, since preferably there is at least about 10% oxygen by volume in the retort inlet mixture, the amount of water vapor in the retort inlet mixture is generally less than about 90% by volume. Preferably air is the source of oxygen. Because of non-reactive components of air such as nitrogen, when there is 10% or more oxygen by volume in the retort inlet mixture, the maximum concentration of water vapor obtainable in the retort inlet mixture when air is used as the source of oxygen for the retort inlet mixture is about 50% by volume.

The water in the retort inlet mixture can be a portion of the water withdrawn from the sump at the bottom of an in situ oil shale retort. This is an advantageous use of such water since it can contain some hydrocarbon products of retorting and inorganic materials and therefore could require treatment before release to the environment. When such water is used in the process, treatment is not required. Water containing impurities from other sources such as boiler blow down and sewage can be used as the source of water.

Exemplary of suitable retort inlet mixtures is one generated by combining about 7,900 SCFM (standard cubic feet per minute) air, about 3.5 gallons per minute of water, and about 87 SCFM of fuel gas having a heating value of 2,300 BTU/SCF. This combination forms by oxidation of the fuel gas and resultant vaporization of the water, a retort inlet mixture having a temperature of about 1200° F. containing about 14% by volume of oxygen and about 12% by volume water vapor, with the remainder comprising principally combustion products of the fuel gas and nonreactive components of the air. This retort inlet mixture provides about 0.6 SCFM of gas per square foot of retort cross-sectional area for a retort 118 feet square.

Also exemplary of suitable retort inlet mixtures is one generated by combining about 7,900 SCFM of air, about 3.5 gallons/minute water, and about 1.8 gallons/minute of shale oil having a density of about 7.529 lbs/gallon and a net heating value of about 17,500 BTU/lb. The shale oil is produced by in situ retorting of oil shale. This mixture forms by oxidation of the shale oil, a retort inlet mixture having a temperature of about 1400° F. and containing about 14% by volume oxygen and about 13% by volume water vapor, with the remainder comprising principally combustion products of the shale oil and nonreactive components of the air. This retort inlet mixture provides about 0.6 SCFM of retort inlet mixture per square foot of retort cross-sectional area for a retort 118 feet square.

Gases are passed from the zone of hot combusted oil shale into the primary combustion zone at a rate sufficient to maintain the maximum temperature in the combustion zone at a temperature above the retorting temperature of the oil shale and to advance the primary combustion zone through the in situ oil shale retort. In the primary combustion zone, residual carbonaceous material in the retorted oil shale is believed to be oxidized to yield carbon dioxide according to reactions (1) and (2) above and the reaction:

$$C+O_2 \rightarrow CO_2 \quad (3)$$

Reactions (2) and (3), which are exothermic, generate heat required for the endothermic retorting of kerogen in the oil shale in the retorting zone. Carbon dioxide produced by carbonate decomposition within a large oil shale particle can react with residual carbonaceous material contained therein by reaction (1). Also, carbon dioxide generated by oxidation of fuel for generation of a hot retort inlet mixture can react with residual carbonaceous material contained in oil shale particles by reaction (1).

If carbonaceous material in the retort is at a sufficiently high temperature, water vapor can react by the water gas reaction:

$$H_2O+C \rightarrow H_2+CO. \quad (4)$$

or by its equivalent:

$$nH_2O + C_nH_{n+2} \rightarrow (n+1)H_2+nCO \quad (5)$$

The water gas reaction is believed to occur when water contacts carbonaceous material heated to a temperature above about 1200° F. It is thought that the residual carbonaceous material remaining in retorted oil shale is in a highly active form and the water gas reaction can occur at a temperature from about 1000° to 1100° F.

Carbon monoxide generated by the water gas reaction can be oxidized by oxygen in the combustion zone feed according to reaction (2) and hydrogen generated by the water gas reaction can be oxidized according to the reaction:

$$2H_2+O_2 \rightarrow 2H_2O. \quad (6)$$

Carbon monoxide can also be oxidized by the reaction:

$$CO+H_2O \rightarrow CO_2+H_2 \quad (7)$$

Although the water gas reaction is endothermic, reactions (1), (2), and (6) are exothermic. The net result of reactions (2), (4) and (6) is the oxidation of carbon to carbon dioxide with regeneration of the water used in the water gas reaction by reaction (6).

Utilizing the water gas reaction for oxidation of residual carbonaceous material is another reason for maintaining the zone hot combusted oil shale at a temperature of at least about 1150° F.

Oil shale is a poor heat conductor, and therefore, heat generated in a zone in an in situ oil shale retort tends to remain within the zone and increase the temperature of oil shale within the zone. However, with the method described herein, gases are moved through the primary combustion zone in the direction of advancement of the primary combustion zone through the retort. The gaseous mixture passing from the primary combustion zone into the retorting zone contains combustion gas generated in the primary combustion zone and any gaseous unreacted portion of the retort inlet mixture. This gas stream provides the heat required for the endothermic retorting of the kerogen in the oil shale particles.

Retorting of the oil shale in the retorting zone produces gaseous and liquid products such as carbon dioxide, carbon monoxide, hydrogen, hydrogen sulfide, water liberated from the shale, and hydrocarbons. Unretorted oil shale on the advancing side of the retorting zone is at the ambient temperature of the oil shale prior to establishing the combustion zone in the retort, and is below the dew point of gas on the advancing side of the retorting zone. Thus, water, if any, introduced into the retort as part of the retort inlet mixture and any water released from the oil shale can condense on unretorted oil shale. Such condensed water percolates to the bottom of the fragmented mass and is collected in the sump 20 as a portion of the liquid products. Also collected in the sump are hydrocarbons produced in the retorting zone which condense above ambient temperatures. The uncondensed gaseous products, combustion gas from the combustion zone, carbon dioxide from carbonate decomposition, and any gaseous unreacted portion of the retort inlet mixture are withdrawn from the retort through the drift 18 in the off gas stream 22. The off gas stream can be saturated with water vapor.

A method of in situ retorting wherein the retort inlet mixture has a temperature of at least about 1150° F. has significant advantages compared to a method of retorting oil shale where the retort inlet mixture is at ambient temperature. Among these advantages is increased yield of liquid hydrocarbons. It is believed that anhanced yields can be obtained because residual carbonaceous material in oil shale on the trailing side of the combustion zone is maintained at a temperature higher than its spontaneous ignition temperature. Thus, this residual carbonaceous material can react with oxygen in the retort inlet mixture. Also, high temperatures in the zone of hot combusted oil shale on the trailing side of the combustion zone increases the diffusivity of oxygen into oil shale, thereby resulting in oxidation of residual carbonaceous material in large formation particles containing oil shale which otherwise might not react with oxygen. Furthermore, carbon dioxide produced by carbonate decomposition in large particles of oil shale can react with residual carbonaceous material by reaction (1) and generate heat by the reaction (2) to effect retorting of kerogen in the retorting zone. Thus, enhanced yields of hydrocarbon products can be obtained because residual carbonaceous material which otherwise might not have reacted with oxygen is used to produce the energy required for retorting, thereby allowing kerogen in the retorting zone to be retorted, rather than being oxidized to generate energy required for retorting.

Also contributing to enhanced yields obtained with a retort inlet mixture having a temperature of at least about 1150° F. is that kerogen in unfragmented formation adjacent the retort and kerogen bypassed by the retorting and combustion zones, such as kerogen in oil shale in the upper corners of the retort, are used to produce hydrocarbon products. This kerogen otherwise might not have been retorted.

Another advantage of the method of this invention is minimization of water usage when the retort inlet mixture contains water vapor. Compared to methods where liquid water is introduced into a retort, or a retort inlet mixture containing water vapor where the retort inlet mixture is at a relatively low temperature, less water is absorbed by oil shale on the trailing side of the primary combustion zone. This is because the zone of hot combusted oil shale is at a temperature greater than the temperature at which alkaline earth metal oxides, which are formed by thermal decomposition of alkaline earth metal carbonates during retorting and combustion, combine with water to form alkaline earth metal hydroxides. For example, magnesium hydroxide decomposes with release of water to oxide at a temperature of 662° F. (350° C.) and calcium hydroxide decomposes with release of water at a temperature of 1076° F. (580° C.). Thus calcium oxide and magnesium oxide cannot be hydrated in the zone of a hot combusted oil shale because, according to this invention, the zone of a combusted oil shale is maintained at a temperature greater than about 1150° F. Since retorted and combusted oil shale can contain large quantities of alkaline earth metal oxides, i.e., approximately 20 to 30% calcium oxide and 5 to 10% magnesium oxide, avoiding hydration of alkaline earth metal oxides can result in significant savings in water. Because water is a valuable commodity in the western portion of the United States where the bulk of oil shale reserves are located, recovery of water introduced into a retort is important.

Another advantage of maintaining the retort inlet mixture at a temperature of at least about 1150° F. is that a portion of the heat required for retorting oil shale in the retorting zone can be obtained from the heat content of the retort inlet mixture. Thus, less heat needs to be generated in the primary combustion zone and less oxygen needs to be introduced into the primary combustion zone compared to when the retort inlet mixture is at ambient temperature. Therefore, improved yields are obtained because there is less chance for oxygen to infiltrate the retorting zone and combine therein with hydrocarbon products of retorting.

In a preferred version of this invention, the retort inlet mixture contains water vapor. A method of in situ retorting wherein the retort inlet mixture includes water and the retort inlet mixture has a temperature of at least about 1150° F. has significant advantages compared to a method of retorting oil shale where the retort inlet mixture does not contain water vapor and/or has a temperature less than 1150° F. Among these advantages is increased yield of liquid hydrocarbon products. It is believed that this improved yield is at least partially attributable to higher diffusivity of water vapor through oil shale as compared to the diffusivity of oxygen through oil shale. Because water vapor has higher diffusivity and the retort inlet mixture is at an elevated temperature, water is able to react with residual carbonaceous material in the internal portions of large shale particles and in unfragmented shale along the boundaries of the retort which otherwise would not be reached by oxygen or would be reached at a much later time. Thus the heating value of residual carbonaceous material which would otherwise go unrecovered is obtained for use in retorting additional hydrocarbon product.

It also is believed that the presence of water improves hydrocarbon yields by thickening the retorting zone. It has been calculated that when at least about 10% water vapor by volume is included in the combustion zone feed, there is an increase of about 50% in thickness of a zone having a temperature of 400° F. at its leading edge and about 700° F. at its trailing edge. This is believed to be the result of the high heat capacity of water vapor compared to the heat capacity of combustion gas generated in the primary combustion zone. Because water vapor has a higher heat capacity it can carry more heat per unit volume from the primary combustion zone to the oil shale in the retorting zone than the combustion gas. Thus, for a given primary combustion zone temperature and fixed rate of flow of the retort inlet mixture, more thermal energy passes from the primary combustion zone to the retorting zone as the proportion or concentration of water vapor in the gases increases, thereby resulting in a thicker retorting zone.

It is believed a thicker retorting zone contributes to increased yields for two reasons. First, because of the thicker retorting zone, there is less chance that oxygen present in the combustion zone can reach the portion of the retorting zone where the bulk of hydrocarbon products are produced to oxidize these products. Second, because of a thicker retorting zone, the oil shale can be maintained at retorting temperature for a longer period of time, thereby allowing more hydrocarbons to be produced from the kerogen.

Also contributing to enhanced yields is that the retort inlet mixture can contain much higher concentrations of water vapor than of oxygen because even at high concentrations of water vapor in the retort inlet mixture, fusion of the mass of fragmented oil shale particles does not occur. At high oxygen concentrations such fusion can occur. A high concentration of a gas such as water vapor or oxygen which is reactive with residual carbonaceous material in the retort inlet mixture is desirable because the rate of diffusion of a gas into oil shale is dependent on the concentration of the gas. Thus at very high concentrations of water vapor, which cannot be achieved with oxygen due to the problem of fusion; penetration into even the larger fragmented oil shale particles occurs. Therefore the heating value of the residual carbonaceous material contained therein is recovered and enhanced yields are obtained.

Another advantage of retorting with a retort inlet mixture having an elevated temperature and comprising water is enhancement of the fuel value of the retort off gas. In retort operations utilizing a gaseous feed comprising air and recycled retort off gas, and having a temperature about the same as ambient temperature, the heating value of the retort off gas is relatively low, i.e., in the order of about 20 to 60 BTU/SCF on a dry basis. Such retort off gas is of marginal value, if usable at all, for use in a work engine to generate power, and if it is used, it may be necessary to augment the retort off gas with other combustible material. It is found that when the retort inlet mixture contains water vapor, an off gas with a heating value of from about 50 to about 100 BTU/SCF or higher can be obtained. At such heating value the off gas is satisfactory for combustion in a work engine such as a gas turbine 26. Relatively high heating value off gas can be used as at least part of the fuel of the retort inlet mixture. It is believed that this improvement in the heating value of the off gas is attributable to two factors. First, water vapor contacting heated carbonaceous material in the zone of hot combusted oil shale undergoes the water gas reaction to generate carbon monoxide and hydrogen which enhance the heating value of the off gas. Second, when air is a source of oxygen and water vapor is used as a diluent for the combustion zone feed, the bulk of the water vapor does not appear in the off gas from the retort, but instead is condensed on the shale on the advancing side of the retorting zone and is withdrawn as liquid with the condensed hydrocarbon product. Condensation of the water vapor removes an inert diluent from the off gas, enhancing its fuel value on a volumetric dry basis.

Advantages of providing a retort inlet mixture containing water vapor and oxygen are discussed in the aforementioned U.S. Pat. No. 4,036,299.

The following examples demonstrate that increases in oil yield can be obtained by retorting oil shale according to the method of this invention.

EXAMPLES 1-5

For each of Examples 1-5, a small laboratory retort having an internal diameter of 2.3 inches and a length of 2.7 feet was filled with a fragmented permeable mass of oil shale having a weight average particle size of $\frac{3}{8}$ inch, the oil shale having an average Fischer assay of 19.1 gallons per ton. The superifical inlet gas velocity was maintained at 1.23 SCFM/FT$^2$. The composition of the inlet gas, the temperature of the inlet gas, and oil yield for each example are shown in Table I.

Comparison of the oil yield of Example 3 with the oil yields of Examples 1 and 2, and comparison of the oil yield of Example 5 with the oil yield of Example 4, show that increased oil yield can be obtained by increasing the temperature of the inlet mixture to about 1150° F.

Comparison of the oil yield of Example 4 with the oil yield of Example 1, and comparison of the oil yield of Example 5 with the oil yield of Example 3 show that increased oil yield can be obtained by including steam in the inlet gas.

TABLE I

| Experiment No. | 1 | 2 | 3 | 4 | 5 |
|---|---|---|---|---|---|
| Air conc. in inlet gas, % | 100 | 100 | 100 | 76 | 76 |
| Steam conc. in inlet gas, % | 0 | 0 | 0 | 24 | 24 |
| Inlet gas temperature,°F. | 900-1000 | 1000-1100 | 1100-1200 | 900-1000 | 1100-1200 |
| Oil yield, % F.A. | 61.0 | 74.1 | 74.4 | 75.1 | 78.9 |

Although this invention has been described in considerable detail with reference to certain versions thereof, other versions are within the scope of this invention. For example, although the invention has been described in terms of a single in situ oil shale retort containing both a combustion zone and a retorting zone, it is possible to practice this invention with two serially connected retorts. The first retort would contain retorted oil shale and the combustion zone. The gases generated in the combustion zone of the first retort would be passed to a second retort for retorting raw oil shale contained therein.

In addition, although the drawing shows a retort where the combustion and retorting zones are advancing downwardly through the retort, this invention is also useful for retorts where the combustion and retorting zones are advancing upwardly or transverse to the vertical.

Furthermore, although the invention has been described with water vapor and the source of oxygen comprising a retort inlet mixture being introduced together and continuously into a retort, these two components of the inlet mixture can be introduced intermittently and/or independently into the retort.

Because of variations such as these, the spirit and scope of the appended claims should not necessarily be limited to the description of the preferred versions contained herein.

What is claimed is:

1. In a method for retorting oil shale in an in situ oil shale retort having boundaries of unfragmented formation, the retort containing a fragmented permeable mass of particles containing oil shale and having a combustion zone advancing therethrough and having a retorting zone on the advancing side of the combustion zone, where a retort inlet mixture comprising oxygen is introduced into the retort on the trailing side of the combustion zone and liquid and gaseous products are produced in the retorting zone, the improvement comprising:

introducing the retort inlet mixture at a temperature of at least about 1150° F. such that at least a portion of the fragmented mass on the trailing side of the combustion zone is maintained at a temperature of at least about 1150° F.

2. The method of claim 1 wherein the retort inlet mixture is introduced at a sufficiently high temperature that at least a portion of the boundaries of unfragmented formation adjacent the fragmented mass on the trailing side of the combustion zone is maintained at a temperature above the retorting temperature of oil shale.

3. The method of claim 1 wherein the retort inlet mixture is introduces at a sufficiently high temperature that the at least a portion of the boundaries of unfragmented formation adjacent the fragmented mass on the trailing side of the combustion zone is maintained at a temperature higher than about 900° F.

4. The method of claim 1 wherein the retort inlet mixture is maintained at a sufficiently high temperature that the at least a portion of the boundaries of unfragmented formation adjacent the fragmented mass on the trailing side of the combustion zone is maintained at a temperature higher than about 1200° F.

5. The method of claim 1 wherein the fragmented mass near the top of the in situ oil shale retort is maintained at a temperature of at least about 11500° F. and the combustion zone is advanced downwardly through the retort.

6. The method of claim 1 wherein the retort inlet mixture comprises at least about 10% water vapor by volume.

7. The method of claim 1 wherein the retort inlet mixture comprises from about 10% to about 50% water vapor by volume.

8. The method of claim 1 wherein the fragmented mass contains calcium carbonate and at least a portion of the fragmented mass on the trailing side of the combustion zone is maintained at a temperature at least as great as the temperature at which calcium carbonate decomposes to release carbon dioxide.

9. A method for producing liquid hydrocarbon products from unfragmented formation adjacent to a fragmented permeable mass of formation particles containing oil shale in an in situ oil shale retort, wherein an oxygen supplying gas is introduced into the in situ oil shale retort to simultaneously advance a combustion zone and a retorting zone through the in situ oil shale retort; which comprises the steps of:

establishing a zone of hot combusted oil shale in the in situ oil shale retort on the trailing side of the combustion zone; and introducing the oxygen supplying gas into the in situ oil shale retort at a temperature of at least about 1150° F. such that the temperature of the zone of the hot combusted oil shale is maintained at a temperature of at least about 1150° F. and the heat from the zone of hot combusted oil shale is supplied to unfragmented formation adjacent the zone of hot combusted oil shale for producing hydrocarbon products from unfragmented formation adjacent the zone of hot combusted oil shale.

10. The method of claim 9 wherein the zone of hot combusted oil shale is established near the top of the in situ oil shale retort and the combustion zone is advanced downwardly through the retort.

11. The method of claim 10 wherein the upstream edge of the zone of hot combusted oil shale is maintained near the top of the in situ oil shale retort and the combustion zone is advanced downwardly through the retort.

12. The method of claim 9 wherein the zone of hot combusted oil shale is maintained near the top of the in situ oil shale retort and the combustion zone is advanced downwardly through the retort.

13. The method of claim 9 wherein the oxygen supplying gas comprises at least about 10% water vapor by volume.

14. The method of claim 13 wherein the zone of hot combusted oil shale is maintained at a sufficiently high temperature that water vapor in the oxygen supplying gas reacts with residual carbonaceous material in the zone of hot combusted oil shale.

15. A method for recovering liquid and gaseous products from an in situ oil shale retort in a subterranean formation containing oil shale, said in situ oil shale retort having boundaries of unfragmented formation and containing a fragmented permeable mass of particles containing oil shale and having a combustion zone advancing therethrough, the fragmented mass of particles on the trailing side of the combustion zone containing residual carbonaceous material, which comprises the steps of:

introducing into the in situ oil shale retort on the trailing side of the combustion zone a retort inlet mixture containing oxygen, the retort inlet mixture having a sufficiently high temperature that at least a portion of the fragmented mass on the trailing side of the combustion zone is maintained at a temperature of at least about 1150° F. such that oxygen in the retort inlet mixture reacts with residual carbonaceous material in the fragmented mass on the trailing side of the combustion zone to generate a combustion zone feed containing oxygen;

passing the combustion zone feed into the combustion zone to advance the combustion zone through the fragmented mass of particles and produce combustion gas;

passing said combustion gas and any gaseous unreacted portion of the retort inlet mixture through a retorting zone in the fragmented mass of particles on the advancing side of the combustion zone whereby oil shale is retorted and gaseous and liquid products are produced; and withdrawing liquid products and retort off gas comprising gaseous products, combustion gas, and any gaseous unreacted portion of the retort inlet mixture from the in situ oil shale retort on the advancing side of the retorting zone.

16. The method of claim 15 wherein the retort inlet mixture is introduced at a sufficiently high temperature that at least a portion of the boundaries of unfragmented formation adjacent the fragmented mass on the trailing side of the combustion zone is maintained at a temperature above the retorting temperature of oil shale.

17. The method of claim 15 wherein the retort inlet mixture is introduced at a sufficiently high temperature that at least a portion of the boundaries of unfragmented formation adjacent the fragmented mass on the trailing side of the combustion zone is maintained at a temperature higher than about 900° F.

18. The method of claim 15 wherein the retort inlet mixture is introduced at a sufficiently high temperature that at least a portion of the boundaries of unfragmented formation adjacent the fragmented mass on the trailing side of the combustion zone is maintained at a temperature higher than 1200° F.

19. The method of claim 15 wherein the fragmented mass near the top of the in situ oil shale retort is maintained at a temperature of at least about 1150° F. and the combustion zone is advanced downwardly through the retort.

20. The method fo claim 15 wherein the retort inlet mixture contains at least about 10% water vapor by volume.

21. The method of claim 20 wherein at least a portion of the fragmented mass on the trailing side of the combustion zone is maintained at a sufficiently high temperature that water vapor in the retort inlet mixture reacts with residual carbonaceous material contained in the fragmented mass on the trailing side of the combustion zone for generating hydrogen and carbon monoxide.

22. A method for retorting oil shale in an in situ oil shale retort in a subterranean formation containing oil shale for producing gaseous and liquid products, the retort containing a fragmented permeable mass of formation particles containing oil shale, comprising the steps of:

establishing a combustion zone and retorting zone in the fragmented mass;

introducing a combustion zone feed containing oxygen into the combustion zone for advancing the combustion zone and the retorting zone through the fragmented mass, the retorting zone being on the advancing side of the combustion zone, wherein liquid and gaseous products are produced in the retorting zone;

establishing a zone of hot combusted oil shale in the fragmented mass on the trailing side of the combustion zone; and introducing a retort inlet mixture having a sufficient temperature and containing sufficient oxygen into the zone of hot combusted oil shale for maintaining the upstream edge of the zone of hot combusted oil shale at substantially the same location in the fragmented mass and for maintaining the zone of hot combusted oil shale at a temperature of at least about 1150° F. and for forming such a combustion zone feed containing oxygen for advancing the combustion zone through the fragmented mass.

23. The method of claim 22 wherein the retort inlet mixture comprises at least about 10% water vapor by volume.

24. The method of claim 22 wherein the retort inlet mixture comprises from about 10% to about 50% water vapor by volume.

25. The method of claim 22 wherein the fragmented mass contains calcium carbonate and at least a portion of the fragmented mass on the trailing side of the combustion zone is maintained at a temperature at least as great as the temperature at which calcium carbonate decomposes to release carbon dioxide.

26. A method for recovering liquid and gaseous products from an in situ oil shale retort in a subterranean formation containing oil shale, the in situ oil shale retort containing a fragmented permeable mass of formation particles, and having boundaries of unfragmented formation, comprising the steps of:

advancing a combustion zone and a retorting zone through the fragmented mass of particles, thereby forming a zone of hot combusted oil shale containing residual carbonaceous material wherein the retorting zone is on the advancing side of the combustion zone and gaseous and liquid products are produced in the retorting zone; and introducing a retort inlet mixture containing oxygen into the retort on the trailing side of the combustion zone, the retort inlet mixture having a sufficiently high temperature of at least about 1150° F. for supplying sufficient heat to maintain at least a portion of the zone of hot combusted oil shale at a temperature at least as high as the spontaneous ignition temperature of residual carbonaceous material in the zone of hot combusted oil shale.

27. The method of claim 26 wherein the retort inlet mixture contains at least about 10% water vapor by volume.

28. The method of claim 27 wherein the retort inlet mixture contains from about 10 to about 50% water vapor by volume.

29. The method of claim 26 wherein the fragmented permeable mass contains calcium carbonate and the retort inlet mixture has a sufficiently high temperature that at least a portion of the calcium carbonate on the trailing side of the combustion zone decomposes to release carbon dioxide.

* * * * *

UNITED STATES PATENT AND TRADEMARK OFFICE

CERTIFICATE OF CORRECTION

PATENT NO. : 4,192,381

DATED : March 11, 1980

INVENTOR(S) : Chang Yul Cha

It is certified that error appears in the above-identified patent and that said Letters Patent are hereby corrected as shown below:

Column 2, line 13, "soild" should be -- solid --.
Column 6, line 23, "secondary combustion" should be deleted and -- of hot combusted oil shale -- should be inserted after "zone" and before "at";
Column 6, line 31, "combustion" should be -- combusted --.
Column 7, line 38, "fuel" should be -- feed --.
Column 11, line 28, "anhanced" should be -- enhanced --.
Column 15, line 23, "introduces" should be -- introduced --.
Column 15, line 24, "the" (first occurrence) should be deleted.
Column 15, line 30, "the" (first occurrence) should be deleted.
Column 15, line 36, "11500°F" should be -- 1150°F --.

Signed and Sealed this

*Tenth* Day of *June 1980*

[SEAL]

*Attest:*

SIDNEY A. DIAMOND

*Attesting Officer*

*Commissioner of Patents and Trademarks*